US009162156B2

(12) United States Patent
Cripe

(10) Patent No.: US 9,162,156 B2
(45) Date of Patent: Oct. 20, 2015

(54) BUBBLE WAND AND ASSOCIATED SYSTEMS AND METHODS

(71) Applicant: Target Brands, Inc., Minneapolis, MN (US)

(72) Inventor: Dustin M. Cripe, Minneapolis, MN (US)

(73) Assignee: TARGET BRANDS, INC., Minneapolis, MN (US)

( * ) Notice: Subject to any disclaimer, the term of this patent is extended or adjusted under 35 U.S.C. 154(b) by 0 days.

(21) Appl. No.: 14/153,781

(22) Filed: Jan. 13, 2014

(65) Prior Publication Data

US 2014/0273709 A1 Sep. 18, 2014

Related U.S. Application Data

(60) Provisional application No. 61/782,779, filed on Mar. 14, 2013.

(51) Int. Cl.
*A63H 33/28* (2006.01)

(52) U.S. Cl.
CPC ..... *A63H 33/28* (2013.01)

(58) Field of Classification Search
CPC ..... A63H 33/28
USPC ..... 446/16, 15
See application file for complete search history.

(56) References Cited

U.S. PATENT DOCUMENTS

| | | | | |
|---|---|---|---|---|
| 2,041,423 A | | 5/1936 | Mausolf | |
| D111,212 S | | 9/1938 | Meyer | |
| D153,600 S | | 5/1949 | Graham | |
| D189,508 S | | 12/1960 | Marder | |
| 3,064,387 A | * | 11/1962 | Campbell | 446/21 |
| 3,950,887 A | * | 4/1976 | Kort | 446/15 |
| 4,128,962 A | * | 12/1978 | Anderson | 446/15 |
| 4,152,864 A | * | 5/1979 | Habisohn | 446/15 |

(Continued)

OTHER PUBLICATIONS

"Magical Copper Bubble Wands", printed from http://bumblebeetoys.com/magical-copper-bubble-wands.html#.UQqFoTkvHaY, publicly available at least as early as Jun. 7, 2012 (2 pages).

(Continued)

*Primary Examiner* — Michael Dennis
*Assistant Examiner* — Dolores Collins
(74) *Attorney, Agent, or Firm* — Griffiths & Seaton PLLC; JoAnn M. Seaton

(57) ABSTRACT

A bubble wand includes a primary member and an auxiliary member. The primary member is substantially entirely formed in a first, single plane and defines an elongated slot and a first plurality of bubble-forming rings. The first plurality of bubble-forming rings includes a different bubble-forming ring positioned on each of at least two opposing sides of the elongated slot. Each of the first plurality of bubble-forming rings defines an opening therethrough. The auxiliary member is substantially entirely formed in a second, single plane and is coupled to the primary member such that the auxiliary member extends through the elongated slot of the primary member such that a first side portion of the auxiliary member is maintained on a first side of the primary member and a second side portion of the auxiliary member is maintained on a second side of the primary member. The auxiliary member defines at least one additional bubble-forming ring in each of the first side portion and the second side portion of the auxiliary member.

23 Claims, 16 Drawing Sheets

(56) References Cited

U.S. PATENT DOCUMENTS

| | | | | |
|---|---|---|---|---|
| 4,180,938 | A * | 1/1980 | La Fata et al. | 446/15 |
| 4,955,840 | A * | 9/1990 | Moomaw | 446/17 |
| D317,631 | S | 6/1991 | Neuroth et al. | |
| D318,304 | S | 7/1991 | Neuroth et al. | |
| 5,102,381 | A * | 4/1992 | Danielak et al. | 482/82 |
| D328,109 | S * | 7/1992 | Brunner | D21/402 |
| D332,807 | S * | 1/1993 | Neuroth et al. | D21/402 |
| 5,181,875 | A * | 1/1993 | Hasegawa | 446/15 |
| D333,165 | S * | 2/1993 | Neuroth et al. | D21/402 |
| 5,205,771 | A * | 4/1993 | Sims | 446/21 |
| 5,348,507 | A * | 9/1994 | McGhie et al. | 446/16 |
| D356,736 | S | 3/1995 | Armstrong | |
| 5,419,728 | A * | 5/1995 | Dallara | 446/15 |
| 5,643,035 | A * | 7/1997 | Freese et al. | 446/15 |
| 5,695,379 | A * | 12/1997 | Ho | 446/15 |
| D404,311 | S | 1/1999 | Zimmer et al. | |
| 5,915,600 | A * | 6/1999 | Bitton | 222/464.1 |
| D412,849 | S | 8/1999 | Fuquen et al. | |
| 6,024,623 | A * | 2/2000 | Menow et al. | 446/15 |
| 6,135,842 | A * | 10/2000 | LaFata | 446/15 |
| 6,200,184 | B1 * | 3/2001 | Rich et al. | 446/15 |
| 6,439,944 | B1 * | 8/2002 | La Fata | 446/15 |
| 6,447,356 | B1 * | 9/2002 | Lapointe | 446/16 |
| D466,023 | S | 11/2002 | Eickmeier | |
| D466,415 | S | 12/2002 | Reis | |
| 6,520,822 | B2 * | 2/2003 | Kennedy | 446/15 |
| 6,620,017 | B1 * | 9/2003 | Bitton | 446/16 |
| 6,638,131 | B1 * | 10/2003 | Thai | 446/15 |
| 6,764,370 | B2 * | 7/2004 | Bitton | 446/16 |
| 6,786,251 | B2 * | 9/2004 | Nadel et al. | 141/98 |
| 6,820,662 | B2 * | 11/2004 | Crawford et al. | 141/319 |
| 6,857,928 | B2 * | 2/2005 | Thai | 446/15 |
| 6,884,447 | B2 * | 4/2005 | Baker | 426/104 |
| 6,921,312 | B2 * | 7/2005 | Thai | 446/15 |
| D510,025 | S | 9/2005 | Venkataraman et al. | |
| 6,948,996 | B2 * | 9/2005 | Tobias, Jr. | 446/15 |
| D515,079 | S | 2/2006 | Lodato et al. | |
| 7,052,356 | B2 * | 5/2006 | Thai | 446/15 |
| D532,314 | S | 11/2006 | Todd | |
| 7,163,123 | B2 | 1/2007 | Bezek | |
| 7,169,007 | B1 * | 1/2007 | Kennedy | 446/15 |
| 7,172,484 | B2 * | 2/2007 | Thai | 446/15 |
| 7,223,149 | B2 * | 5/2007 | Thai | 446/15 |
| 7,244,161 | B2 * | 7/2007 | Thai | 446/15 |
| D548,108 | S * | 8/2007 | Lo | D9/719 |
| D550,562 | S | 9/2007 | Yew | |
| D556,579 | S | 12/2007 | Goto et al. | |
| D559,694 | S | 1/2008 | Le Bras-Brown et al. | |
| D567,665 | S | 4/2008 | Cheng | |
| D572,771 | S * | 7/2008 | Styles | D21/402 |
| D582,782 | S | 12/2008 | Toson | |
| 7,476,139 | B2 * | 1/2009 | Thai | 446/15 |
| D589,094 | S * | 3/2009 | Thai | D21/402 |
| 7,524,230 | B2 * | 4/2009 | Thai | 446/15 |
| D603,709 | S | 11/2009 | Lepoitevin | |
| 7,914,359 | B2 * | 3/2011 | Thai | 446/15 |
| 8,123,584 | B2 * | 2/2012 | Thai | 446/15 |
| D655,179 | S | 3/2012 | Kraft et al. | |
| D655,180 | S | 3/2012 | Kraft et al. | |
| D655,181 | S | 3/2012 | Kraft et al. | |
| D655,182 | S | 3/2012 | Kraft et al. | |
| D663,625 | S | 7/2012 | Warneke et al. | |
| D665,671 | S | 8/2012 | Loetz et al. | |
| D668,958 | S | 10/2012 | George et al. | |
| D674,100 | S | 1/2013 | Smith | |
| D674,101 | S | 1/2013 | Smith | |
| D674,102 | S | 1/2013 | Smith | |
| D674,497 | S | 1/2013 | Smith | |
| 8,814,623 | B2 * | 8/2014 | Garcia | 446/15 |
| 8,888,549 | B2 * | 11/2014 | Lo | 446/15 |
| 2002/0115371 | A1 | 8/2002 | Robinson | |
| 2006/0094325 | A1 * | 5/2006 | Thai | 446/16 |
| 2007/0238386 | A1 * | 10/2007 | Schramm | 446/15 |
| 2013/0165012 | A1 * | 6/2013 | Klauber et al. | 446/91 |

OTHER PUBLICATIONS

"Shapes and Bubbles", printed from http://mrstsfirstgradeclass-jill.blogspot.com/2012/03/shapes-and-bubbles.html, available on Mar. 15, 2012 (11 pages).

U.S. Appl. No. 29/449,019, filed Mar. 14, 2013 (13 pages).

Office Action from Canadian Patent Application No. 2,839,059, mailed Apr. 16, 2014 (2 pages).

Office Action from Canadian Patent Application No. 153,957, mailed Apr. 23, 2014 (1 page).

* cited by examiner

BUBBLE WAND AND ASSOCIATED SYSTEMS AND METHODS

CROSS-REFERENCE TO RELATED APPLICATION

This application is a non-provisional application of and claims priority under 35 U.S.C. §119 to U.S. Provisional Patent Application No. 61/782,779, filed Mar. 14, 2013, which is incorporated herein by reference.

BACKGROUND OF THE INVENTION

Hand-held bubble wands and other bubble blowing tools that are dipped into soaps or bubble blowing solutions have been used for many years. Bubble wands typically are generally formed in a single plane with holes for holding bubble solution being defined within that single plane. Such wands typically hold a limited amount of bubble solution following each dip into a reservoir of bubble solution based on their exposed surface area. Accordingly, many repeated dips of the bubble wand into the bubble solution are generally necessary to create a larger amount of bubbles. Non-planar bubble blowing devices typically include bubble enclosures creating crevices and bubble reservoirs in a more complicated design that is too complex for easy use by young children and that increases maintenance for the devices.

SUMMARY

One aspect of the present invention relates to a bubble wand including a primary member and an auxiliary member. The primary member is substantially entirely formed in a first, single plane and defines an elongated slot and a first plurality of bubble-forming rings. The first plurality of bubble-forming rings includes a different bubble-forming ring positioned on each of at least two opposing sides of the elongated slot. Each of the first plurality of bubble-forming rings defines an opening therethrough. The auxiliary member is substantially entirely formed in a second, single plane and is coupled to the primary member such that the auxiliary member extends through the elongated slot of the primary member such that a first side portion of the auxiliary member is maintained on a first side of the primary member and a second side portion of the auxiliary member is maintained on a second side of the primary member. The auxiliary member defines at least one additional bubble-forming ring in each of the first side portion and the second side portion of the auxiliary member. Other bubble wands, associated assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

The present invention relates to a bubble wand having open, bubble-forming rings formed on each of two separate planes for forming bubbles when bubble solution is blown therethrough. For example, a primary member forms bubble-forming rings substantially within a first plane. A second or auxiliary member forms additional bubble-forming rings substantially within a second plane. The auxiliary member is coupled with the primary member, for example, such that the first plane and the second plane extend in two separate directions, for example, in directions substantially perpendicular to one another. In examples, the additional planes and bubble-forming rings allow more bubble solution to be taken up by the bubble wand per dip in the bubble solution, thereby, allowing more bubbles to be blown through the bubble wand before the bubble wand needs to be re-dipped in the bubble solution depending upon the particular bubble solution used. Fewer dips of the bubble wand in the bubble solution is particularly advantageous when children use the bubble wand, as fewer dips generally results in a decreased likelihood of spilling the bubble solution and/or generally less overall mess in using the bubble wand with the bubble solution. In addition, by having bubble-forming rings on two or more planes, in one example, a user initially blows or otherwise create bubbles through the bubble-forming rings of one plane and subsequently blows or otherwise creates bubbles through the bubble-forming rings of the different plane increasing enjoyment time. In another example, a user rotates the bubble wand and blows at the bubble wand substantially along a line that is not parallel with either of the first plane or the second plane such that bubbles are formed through the bubble-forming rings of both planes substantially simultaneously thereby creating more bubbles at a single time.

More specifically, turning to the figures, FIGS. 1-6 illustrate a bubble wand 10 having a first or primary member 12 and a second, cross, or auxiliary member 14 coupled thereto such that each of primary member 12 and auxiliary member 14 substantially extends within a different plane. For example, the different planes may be angled relative to one another at least about forty-five degrees, such as different planes that extend substantially perpendicularly relative to one another. In one embodiment, each of primary member 12 and auxiliary member 14 is formed as a single piece of a suitable plastic, such as plastic used in injection molding.

Figure 1:
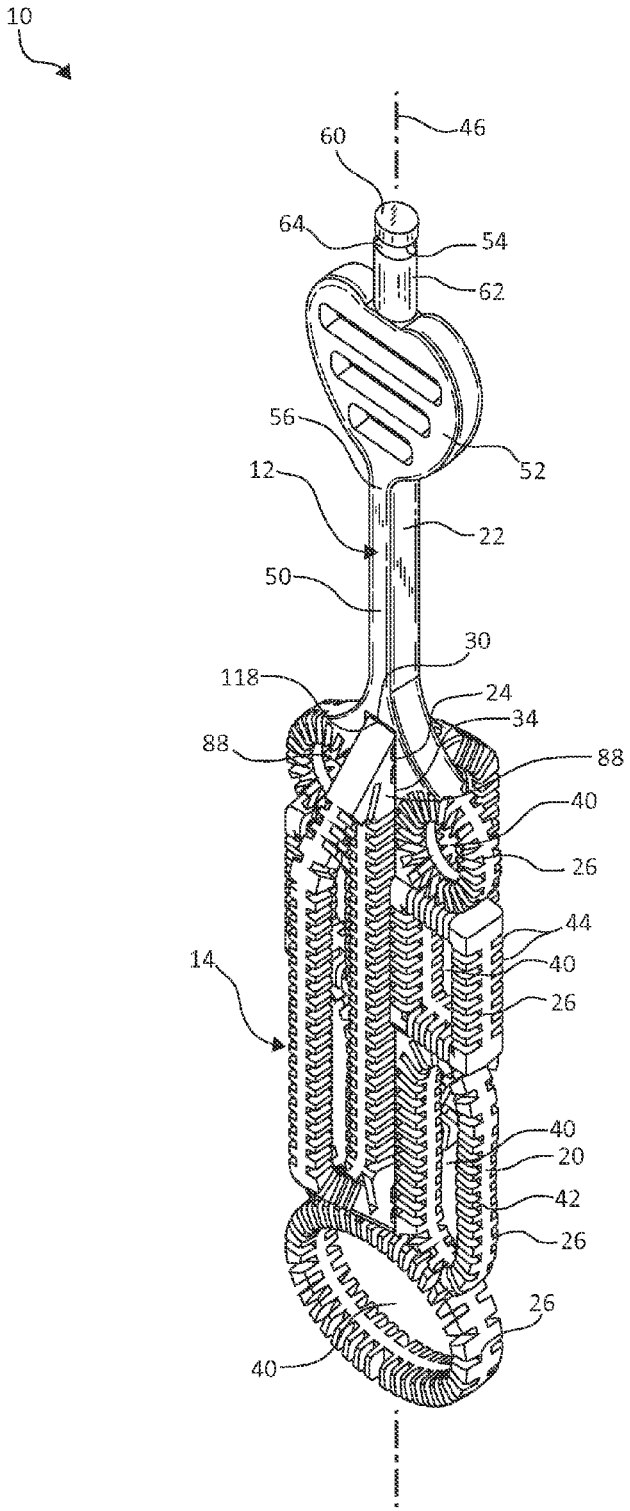
FIG. 1 is a front, perspective view illustration of a bubble wand, according to one embodiment of the present invention.
Figure 2:
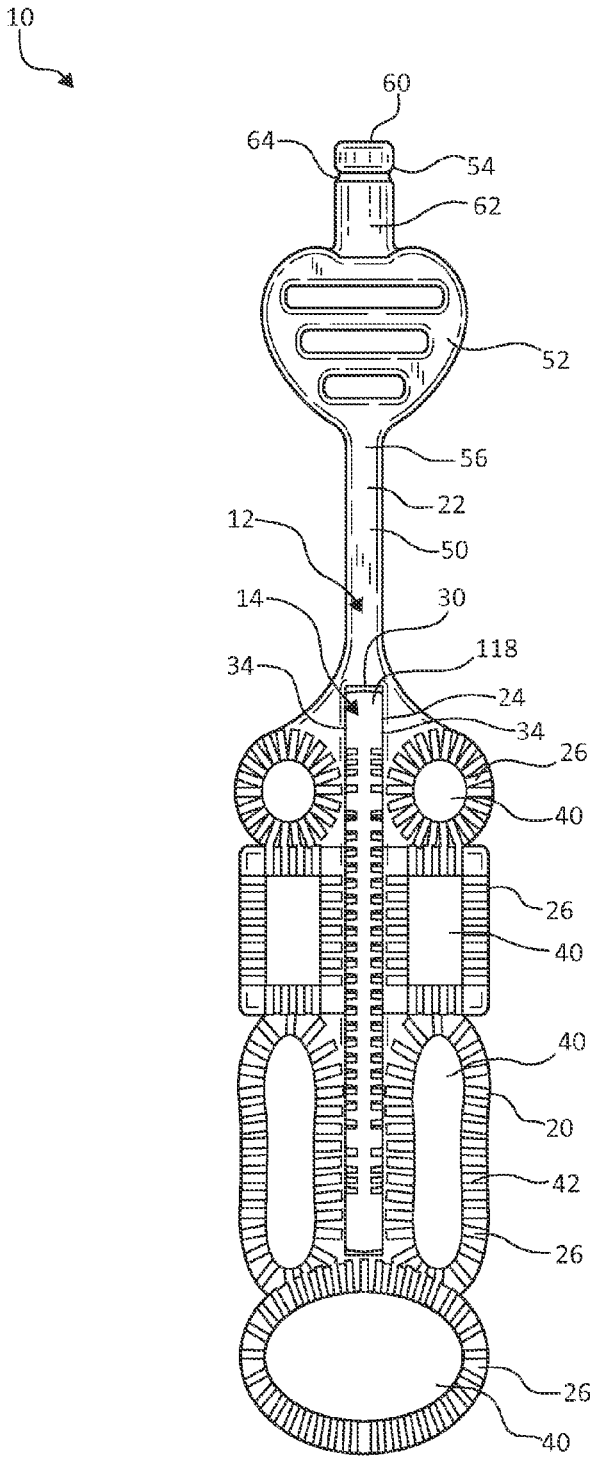
FIG. 2 is a front view illustration of the bubble wand of FIG. 1, according to one embodiment of the present invention.
Figure 3:
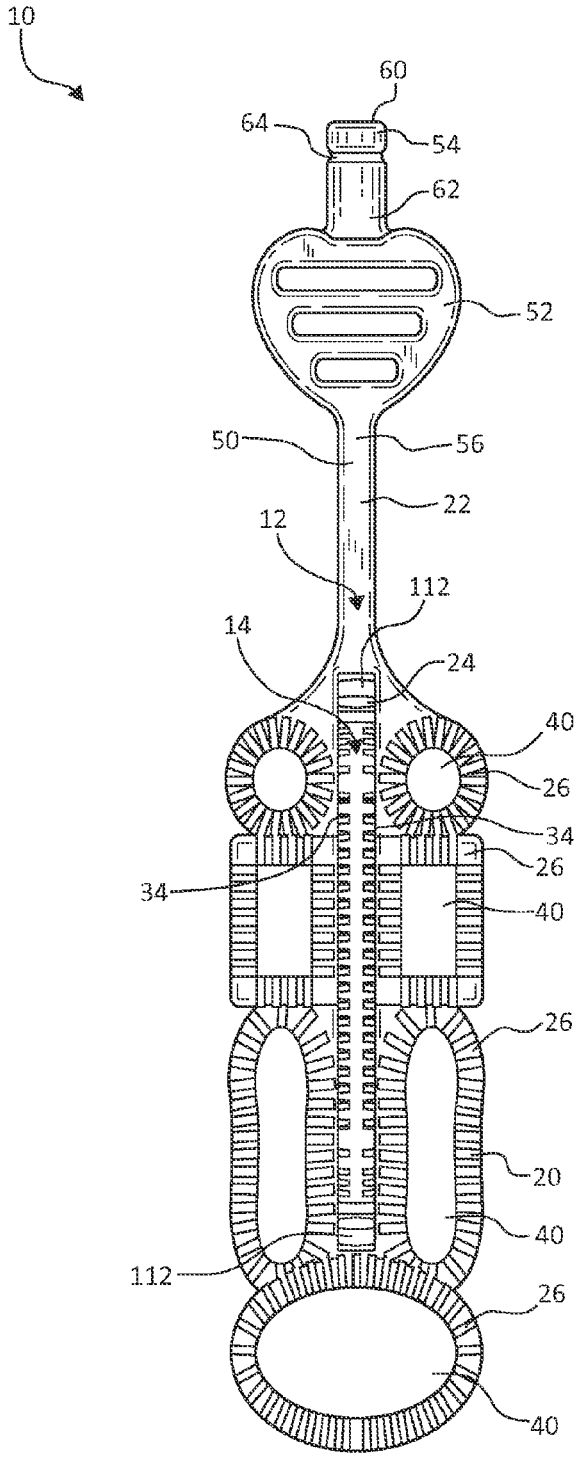
FIG. 3 is a rear view illustration of the bubble wand of FIG. 1, according to one embodiment of the present invention.
Figure 4:
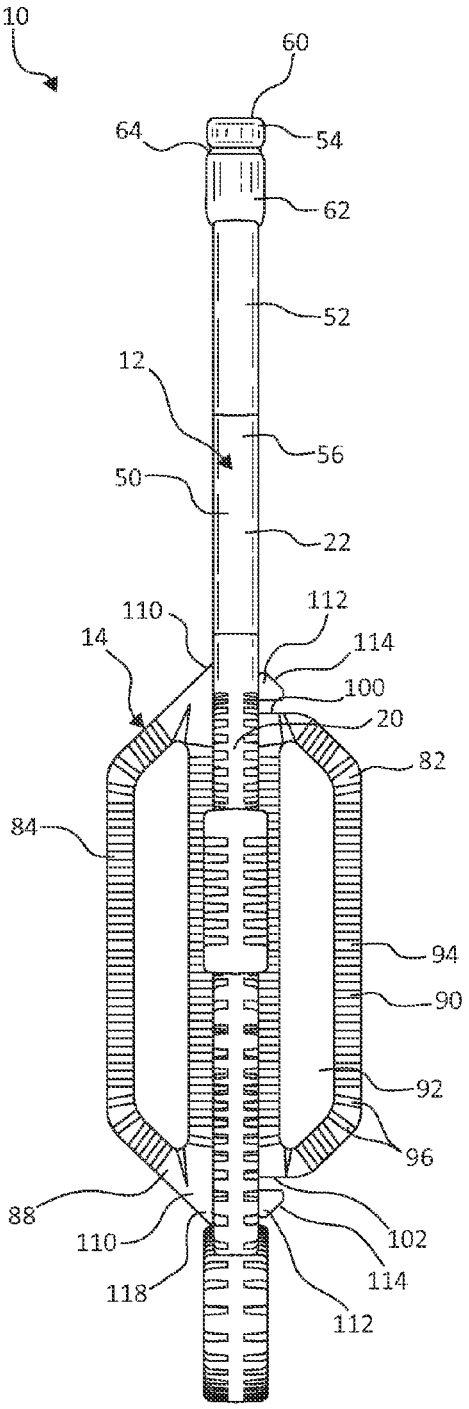
FIG. 4 is a right side view illustration of the bubble wand of FIG. 1 with the left side view being a mirror image of the right side view, according to one embodiment of the present invention.
Figure 5:
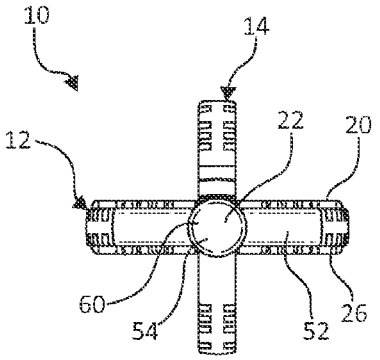
FIG. 5 is a top view illustration of the bubble wand of FIG. 1, according to one embodiment of the present invention.
Figure 6:
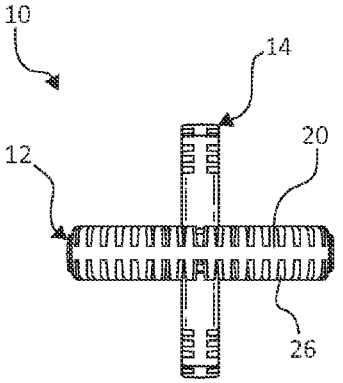
FIG. 6 is a bottom view illustration of the bubble wand of FIG. 1, according to one embodiment of the present invention.
Figure 7:
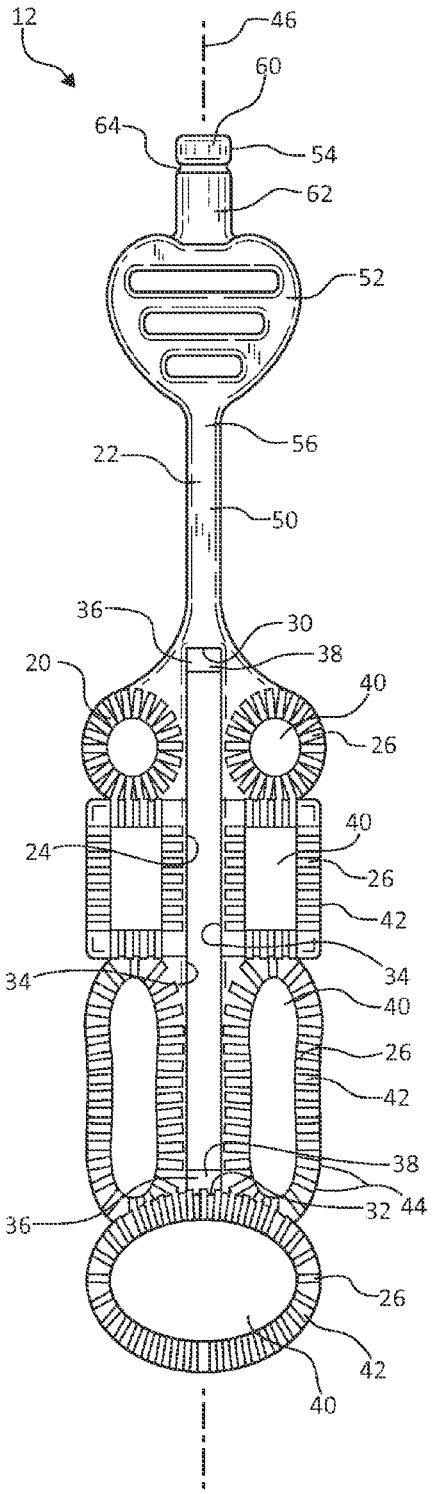
FIG. 7 is a front view illustration of a primary member of the bubble wand of FIG. 1, according to one embodiment of the present invention.

A front view of one embodiment of primary member 12 is illustrated in FIG. 7. As illustrated, primary member 12 is substantially formed in a single plane. For purposes of this application, an extension or formation substantially in a single plane includes members having a generally two-dimensional (e.g., height and width) extension with a thickness of the member being substantially less than a height and a width thereof, e.g., for members having a thickness that is less than about five percent, and in one example, less than about 10 percent, of either the height or width of the same member. Stating that a member extends or is formed substantially in a single plane does not require the member to include any flat or smooth surface.

Primary member 12 includes a bubble-forming body 20 and a handle 22 extending away from bubble-forming body 20. In one example, bubble-forming body 20 includes a central, vertically extending elongated slot 24 surrounded on at least two sides, for example, at least three sides (i.e., a right side, a left side, and a bottom side) by bubble-forming rings 26. In one embodiment, elongated slot 24 is sized to have a height substantially equal to a height of auxiliary member 14 and a width configured to receive a thickness of auxiliary member 14. In one embodiment, elongated slot 24 is substantially rectangular and defines a top edge 30, a bottom edge 32 opposite top edge 30, and two opposing side edges 34. An indentation 36 is formed at one or both sides of primary member 12 immediately adjacent top edge 30 and bottom edge 32 such that a thinned section 38 of thinner material is formed between the two indentations 36 adjacent top edge 30 and between the two indentations 36 adjacent bottom edge 32 as compared to other portions of bubble-forming body 20.

Each bubble-forming ring 26 forms an opening 40 therethrough surrounded by a serrated or toothed perimeter 42, that is, a perimeter characterized by teeth 44 or protruding or larger bumps or portions of material repeatedly interposed between thinner extensions of material. Each opening 40 allows air to pass unimpeded therethrough. Teeth 44 are spaced from one another around toothed perimeter 42 to form bubble-forming body 20 in a manner configured to better hold bubble solution 200 (generally indicated in FIG. 21) across each opening 40 of bubble-forming rings 26 via surface tension. More specifically, teeth 44 interact with bubble solution 200 creating additional surface tension in bubble solution 200 in a manner allowing more bubble solution 200 to be held over each corresponding opening 40 than if bubble-forming rings 26 incorporated smooth perimeters, according to one embodiment.

Each bubble-forming ring 26 may take on any suitable shape and/or size depending on a size of a bottle 202 being used therewith, in one example (see FIGS. 9-13, 21, and 22). As illustrated, each bubble-forming ring 26 is round, rectangular, circular, or another closed loop shape with two or more of bubble-forming rings 26 being sized differently than other ones of bubble-forming rings 26. In other instances, all bubble-forming rings 26 are substantially identical in size and/or shape. In one example, the larger ones of bubble-forming rings 26 create the largest bubbles using bubble solution 200, and the larger number of bubble-forming rings 26 generally creates the largest number of bubbles per dip.

Handle 22 extends away from, e.g., upwardly away from, bubble-forming body 20, e.g., in axial alignment with elongated slot 24 along an axial centerline 46 of primary member 12. Handle 22 includes an elongated shaft 50, a broad section 52 positioned near an end of elongated shaft 50 opposite bubble-forming body 20, and a coupling feature 54 on an end of handle 22 adjacent broad section 52. Elongated shaft 50 extends from bubble-forming body 20 to an opposing end 56. Broad section 52 extends from opposing end 56 further away from bubble-forming body 20 to define two opposing wider or broad surfaces 58. In one example, broad section 52 defines a thickness substantially equal to each of shaft 50 and bubble-forming body 20, but has a width that is significantly larger, for example, at least twice as large as a width of shaft 50. In one example, the width of broad section 52 is nearer a width of bubble-forming body 20 than a width of shaft 50.

Figure 15:
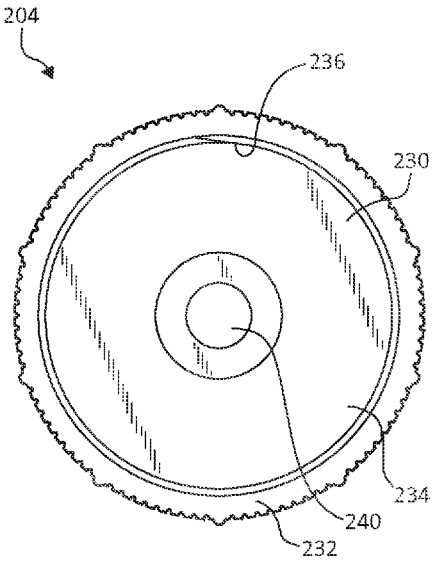
FIG. 15 is a bottom view illustration of the bottle cover of FIG. 14, according to one embodiment of the present invention.
Figure 17:
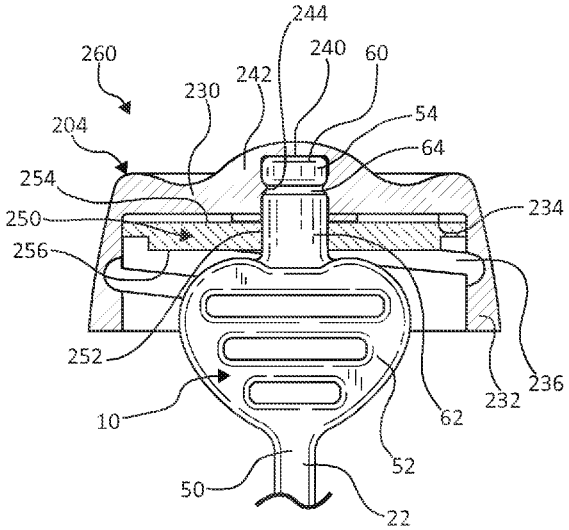
FIG. 17 is a partial cross-sectional front view of a dipping assembly including the bottle cover of FIG. 14, the gasket of FIG. 16, and the bubble wand of FIG. 1, according to one embodiment of the present invention.
Figure 18:
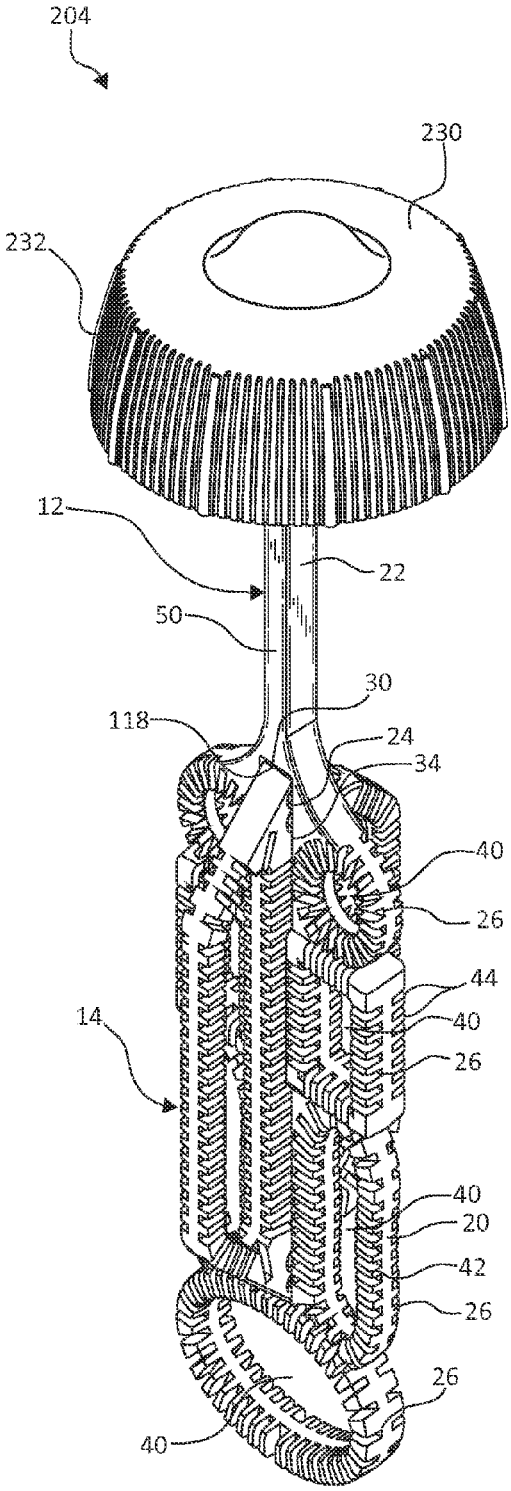
FIG. 18 is a front perspective view illustration of the dipping assembly FIG. 17, according to one embodiment of the present invention.
Figure 19:
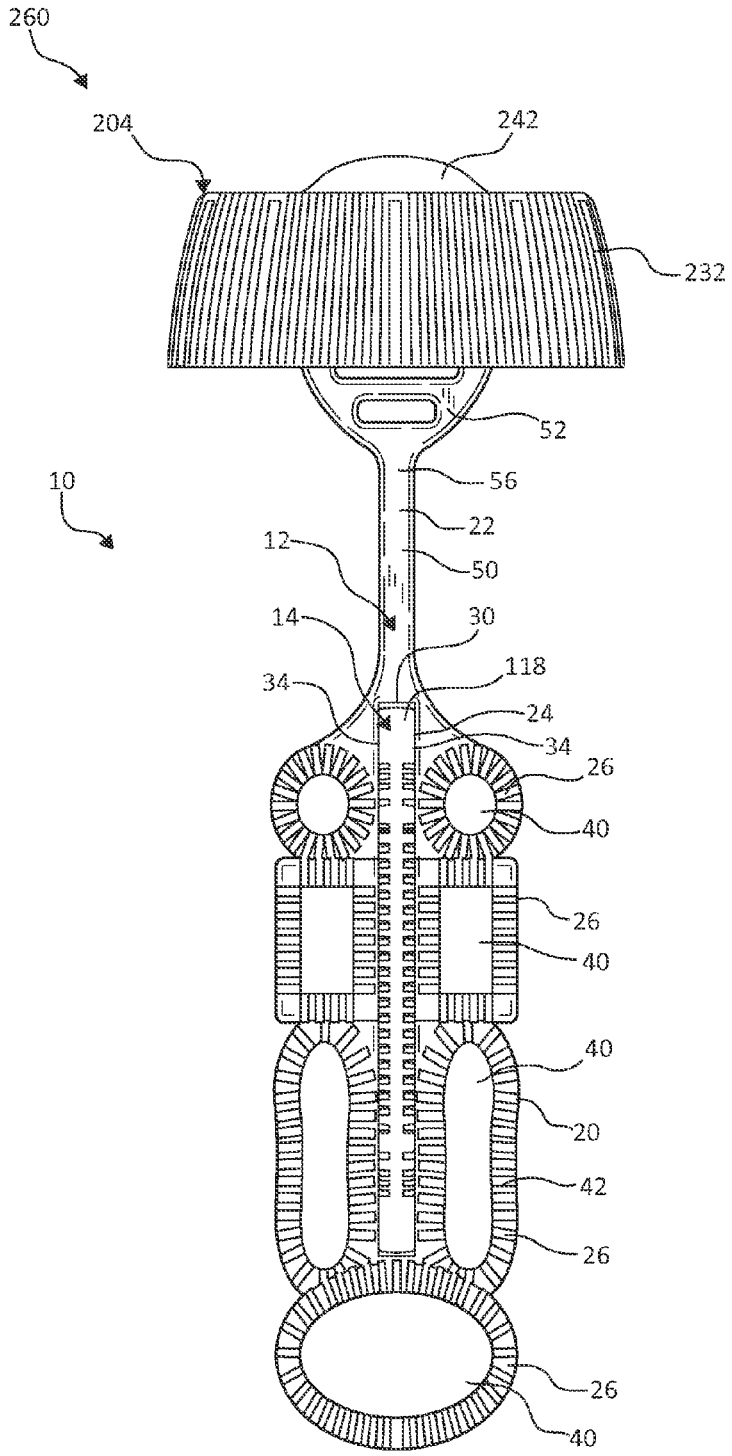
FIG. 19 is a front view illustration of the dipping assembly FIG. 17, according to one embodiment of the present invention.
Figure 20:
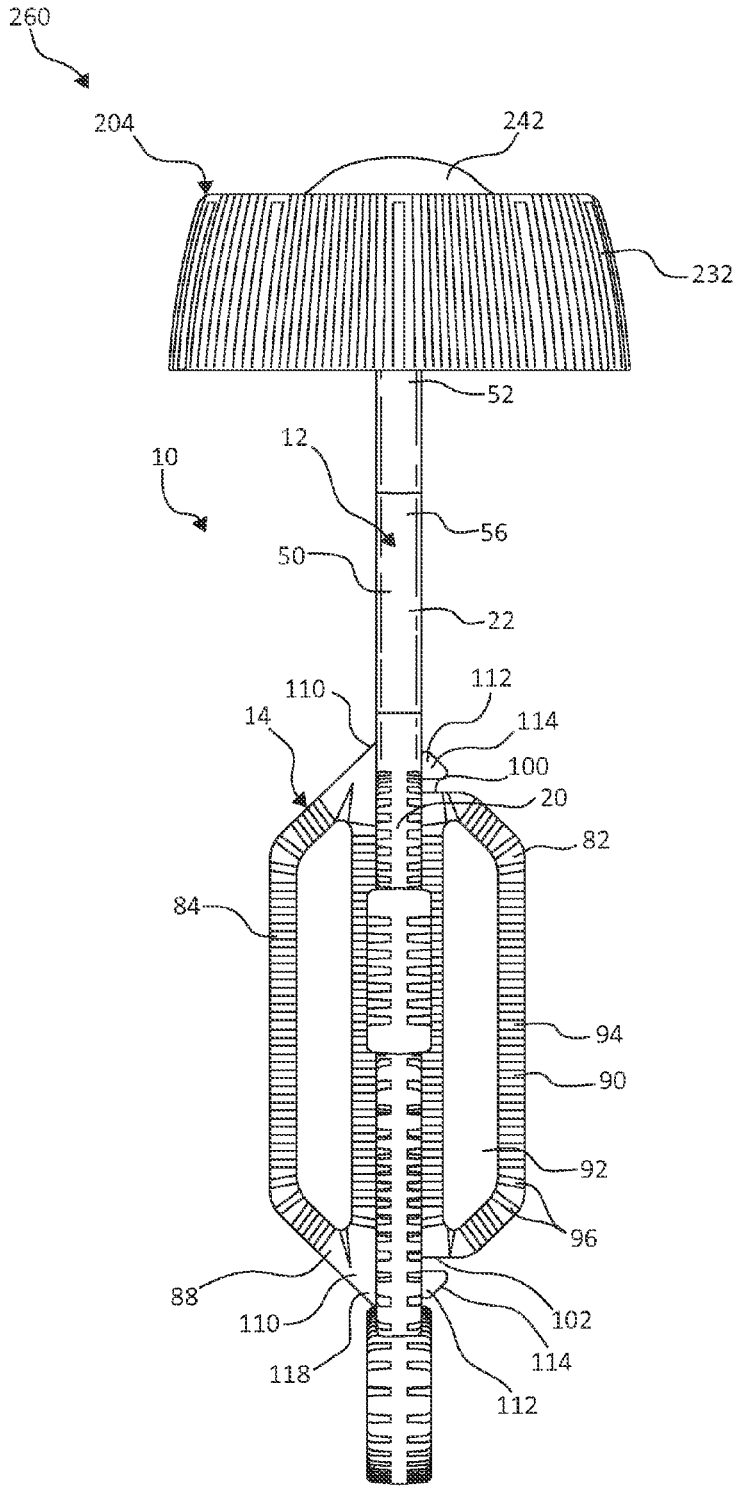
FIG. 20 is a right side view illustration of the dipping assembly FIG. 17, according to one embodiment of the present invention.
Figure 21:
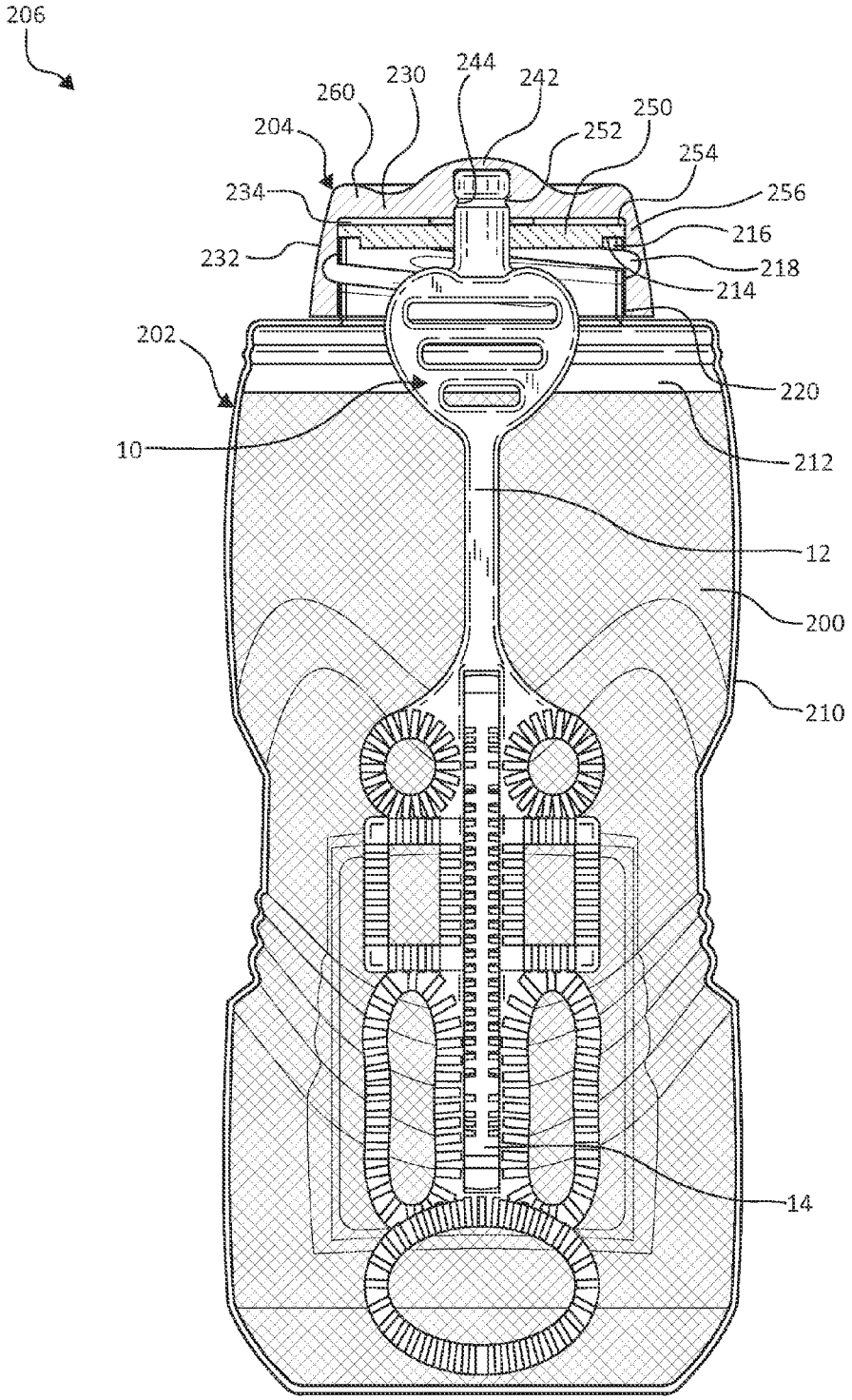
FIG. 21 is a cross-sectional view illustration of the bubble product assembly of FIG. 9 filled with bubble solution, according to one embodiment of the present invention.

In one embodiment, a coupling feature 54 extends from an end of broad section 52 opposite shaft 50 to a free end 60 and is configured to facilitate coupling bubble wand 10 with a bottle cover 204 of a bottle 202 (see. e.g., FIGS. 15, 17, and 21). Coupling feature 54 primarily extends along axial centerline 46 of primary member 12, in one embodiment. For example, coupling feature 54 defines a cylindrical body 62 axially extending relative to shaft 50. In one example, an annular indentation 64 is formed around cylindrical body 62 near a free end 60 thereof to define free end 60 as a bulbous end allowing for snappable, friction fit, or other easy coupling with bottle cover 204 as will be further described below. Other coupling features 54 for coupling bubble wand 10 with bottle cover 204 are also contemplated.

Figure 8:
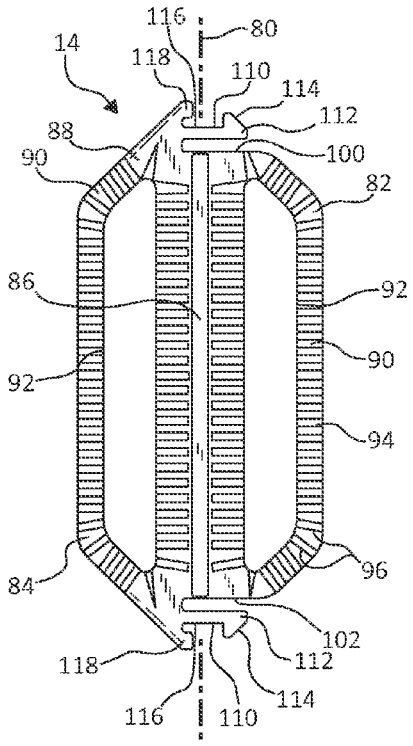
FIG. 8 is right side view illustration of auxiliary member of the bubble wand of FIG. 1, according to one embodiment of the present invention.

Referring to FIG. 8 in addition to FIGS. 1-6, auxiliary member 14 defines an axial centerline 80 and includes a first side portion 82 extending on a first side of axial centerline 80 and a second side portion 84 extending on a second side of axial centerline 80. Auxiliary member 14 defines an elongated, solid spine member 86 extending along axial centerline 80 between first side portion 82 and second side portion 84. In one example, auxiliary member 14 is formed as a single piece extending substantially in a single plane and defines two opposing primary sides or surfaces 88. Each of first side portion 82 and second side portion 84 defines at least one bubble-forming ring 90. Each bubble-forming ring 90 forms an opening 92 therethrough surrounded by a serrated or toothed perimeter 94, that is, a perimeter characterized by teeth 96 or protruding or larger bumps or portions of material repeatedly interposed between thinner extensions of material. Each opening 92 allows air to pass unimpeded therethrough. Teeth 96 are spaced from one another around toothed perimeter 94. In one example, each of first side portion 82 and second side portion 84 define the same number of bubble-forming rings 90, for instance, forming substantially symmetrical relative opening 92 layout between first side portion 82 and second side portion 84.

In one example, first side portion 82 has an overall height less than an overall height of elongated slot 24 of primary member 12 where the overall height of first side portion 82 is defined between a topmost edge 88 and a bottommost edge 90 defined by first side portion 82. Topmost edge 88 and bottommost edge 90 each extend substantially perpendicularly relative to axial centerline 80. Second side portion 84 defines wand-coupling features 110 at a top and bottom thereof. In one example, each of wand-coupling features 110 extends in a cantilevered fashion either above topmost edge 100 or below bottommost edge 102 of first side portion 82.

In one embodiment, each wand-coupling feature 110 defines a hook 112 or other protrusion defining an angled surface 114 extending from a corresponding cantilevered end of a wand-coupling feature 110 away from a respective topmost edge 100 or bottommost edge 102 and toward a remainder of second side portion 84 of auxiliary member 14. A space 116 is left open on a side of each wand-coupling feature 110 opposite topmost edge 100 and bottommost edge 102, respectively. Space 116 is bordered on opposite sides by hook 112 and a protrusion 118. In one example, protrusion 118 is, more specifically, formed at the attachment end of cantilevered wand-coupling feature 110 and extends upwardly or downwardly from top and bottom ends, respectively, further than hook 112. Space 116 defines a width between hook 112 and protrusion 118 that is substantially equal to or greater than a thickness of thinned section 38 of primary member 12 adjacent top edge 30 and bottom edge 32 of elongated slot 24, but less than an overall thickness of primary member 12.

Coupling primary member 12 to auxiliary member 14 assembles bubble wand 10. More specifically, first side portion 82 of auxiliary member 14 is aligned with and slid through elongated slot 24. As first side portion 82 is slid through elongated slot 24, angled surfaces 114 of hooks 112 each interface with one of top edge 30 and bottom edge 32 of elongated slot 24 causing each cantilevered, wand-coupling feature 110 to deflect toward the other wand-coupling feature 110 and allowing each hook 112 to pass through elongated slot 24. Auxiliary member 14 continues to move through elongated slot 24 until hooks 112 fully pass through elongated slot 24 such that deflection of wand coupling features 110 dissipates causing wand coupling feature 110 to return to its original substantially non-deflected position due to a natural bias of each wand-coupling feature 110. As a result, each thinned section 38 of primary member 12 is seated and maintained in a corresponding space 116 between hook 112 and protrusion 118 of auxiliary member 14. In one example, each protrusion 118 fits in one of indentations 36 (FIG. 7) of primary member 12. Auxiliary member 14 substantially entirely fills elongated slot 24 such that no significant voids remain to collect bubble solution 200 (FIG. 21) and/or cause the formation of bubbles therethrough. Accordingly, primary member 12 and auxiliary member 14 couple to one another without the use of tools or fasteners. In one embodiment, once primary member 12 and auxiliary member 14 are coupled to one another they are not readily uncouplable from one another without damaging bubble wand 10. In one example, when bubble wand 10 is assembled axial centerline 46 of primary member 12 and axial centerline 80 of auxiliary member 14 align and, therefore, are substantially collinear.

The resultant bubble wand 10 is substantially bi-planar (e.g., dual plane) and provides for increased surface area and toothed perimeter distance to hold bubble solution 200 (FIG. 21) when bubble wand 10 is dipped in bubble solution 200 as compared with the single planar wands of the prior art. As such, a user is able to rotate bubble wand 10 about axial centerlines 46 and 80 to blow bubble solution 200 through various openings 40 and 92 formed therethrough to generate more bubbles per dip in bubble solution 200 as compared to one dimensional or single plane bubble wands in the prior art.

Figure 9:
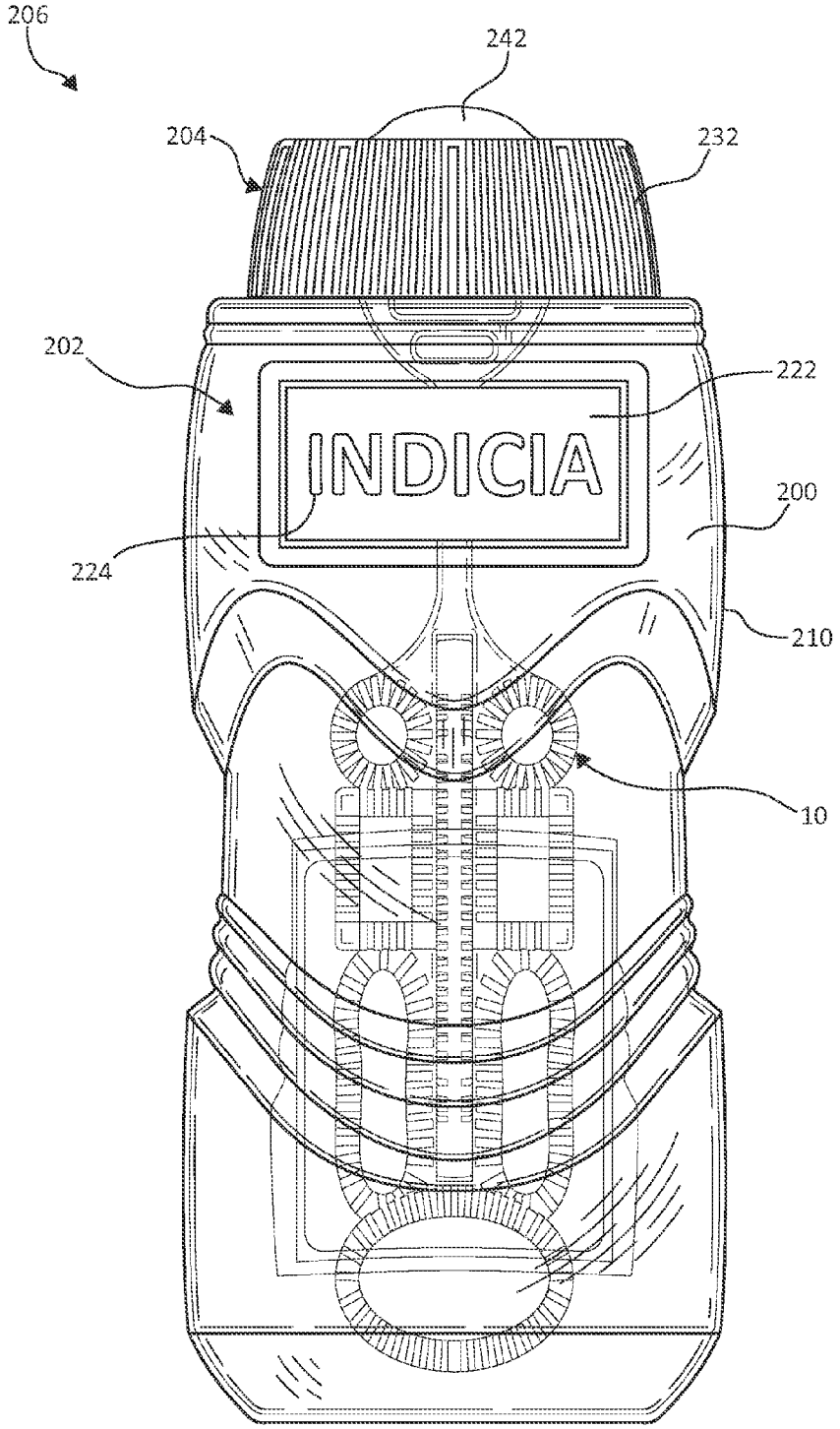
FIG. 9 is a front view of a bubble product assembly, according to one embodiment of the present invention.
Figure 10:
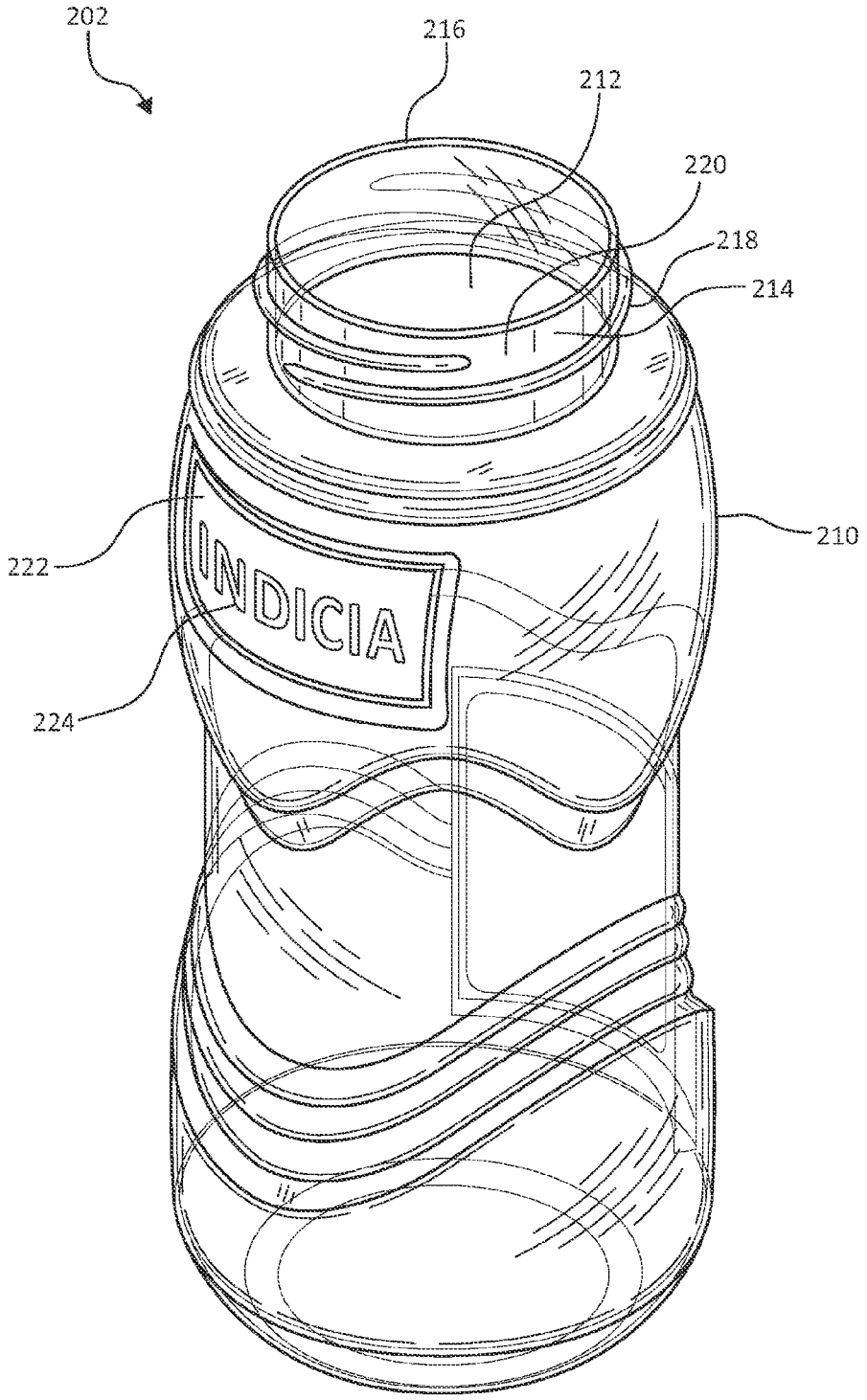
FIG. 10 is a front perspective view illustration of a bottle of the bubble product assembly of FIG. 9, according to one embodiment of the present invention.
Figure 11:
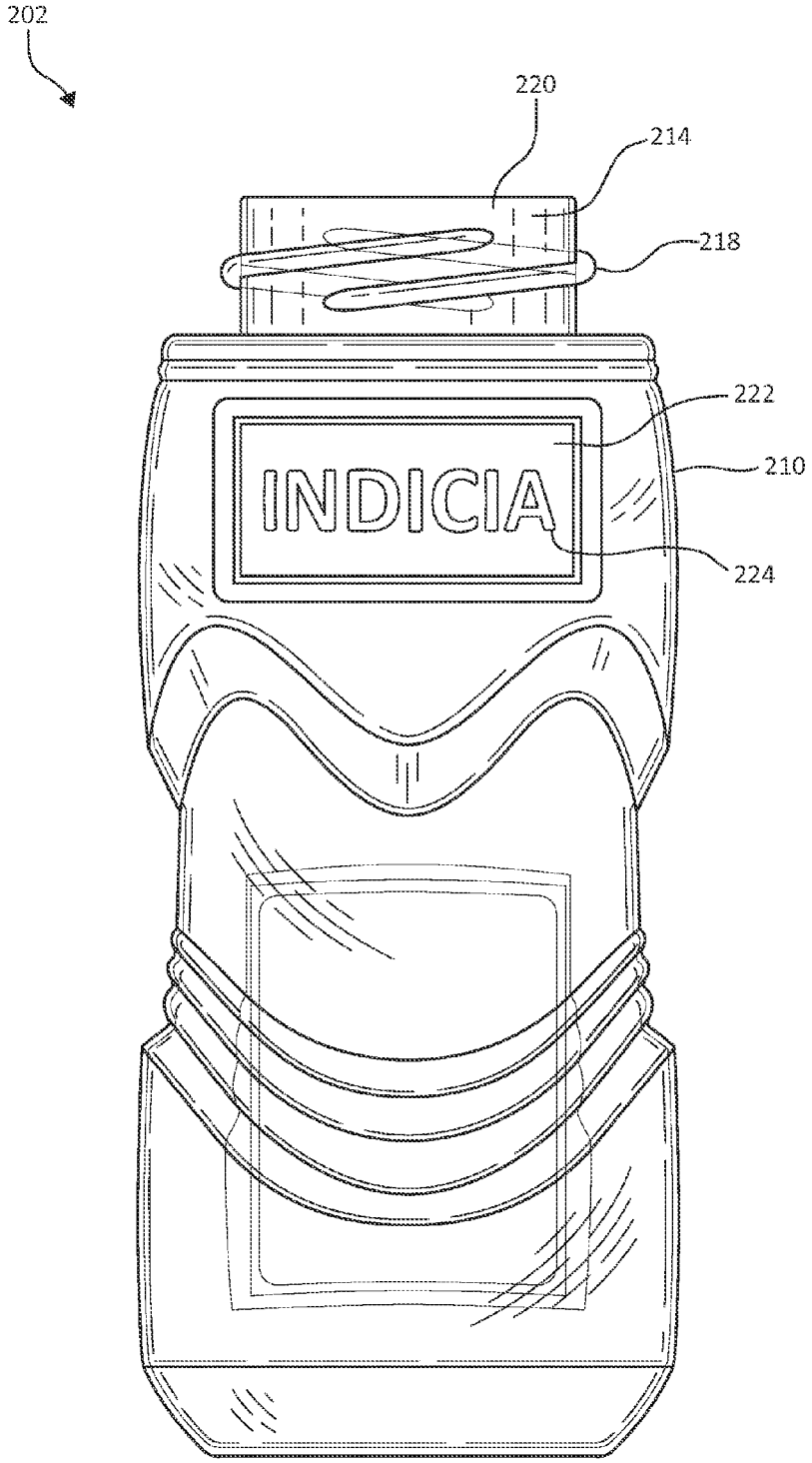
FIG. 11 is a front view illustration of the bottle of FIG. 10, according to one embodiment of the present invention.
Figure 12:
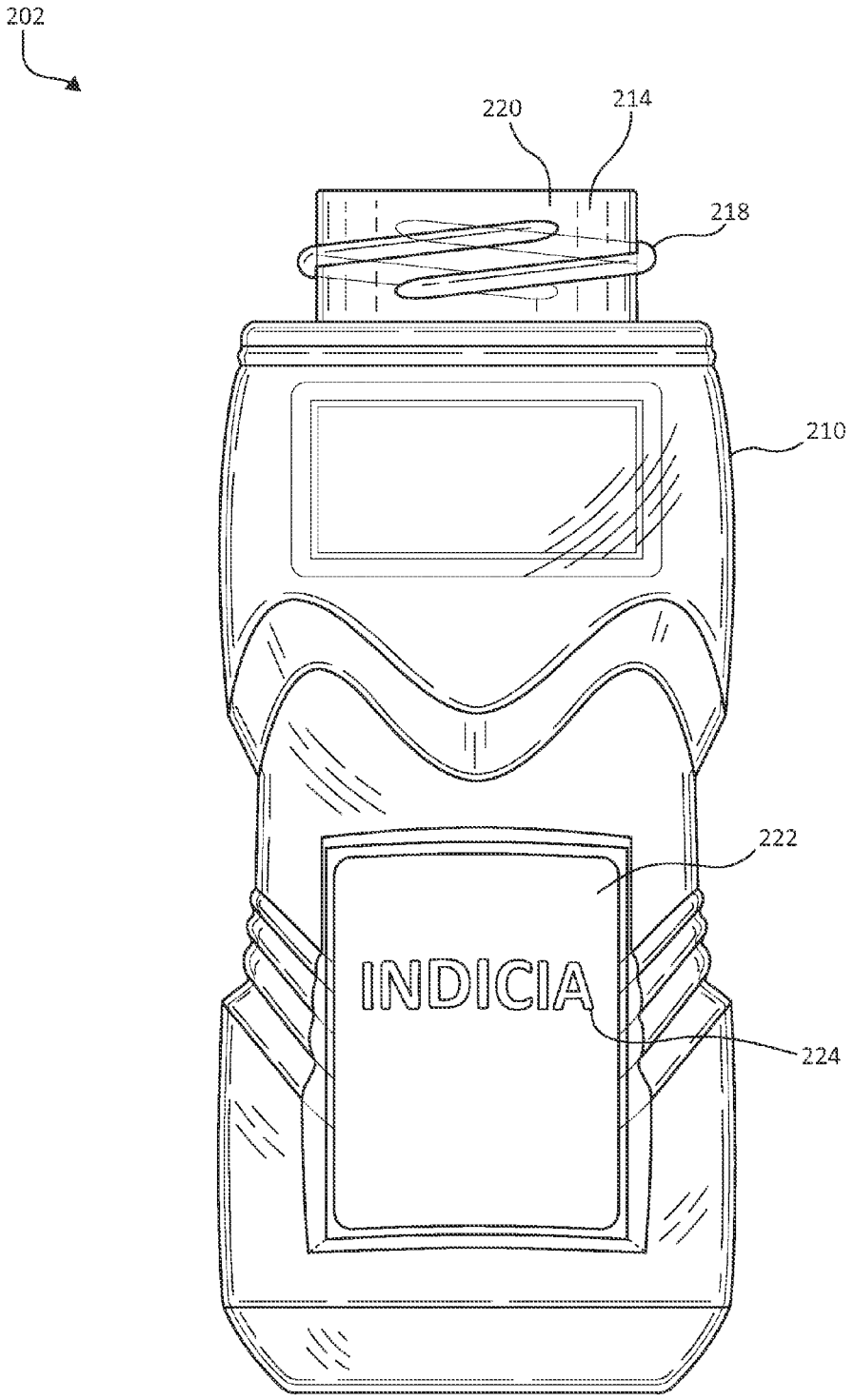
FIG. 12 is a rear view illustration of the bottle of FIG. 10, according to one embodiment of the present invention.
Figure 13:
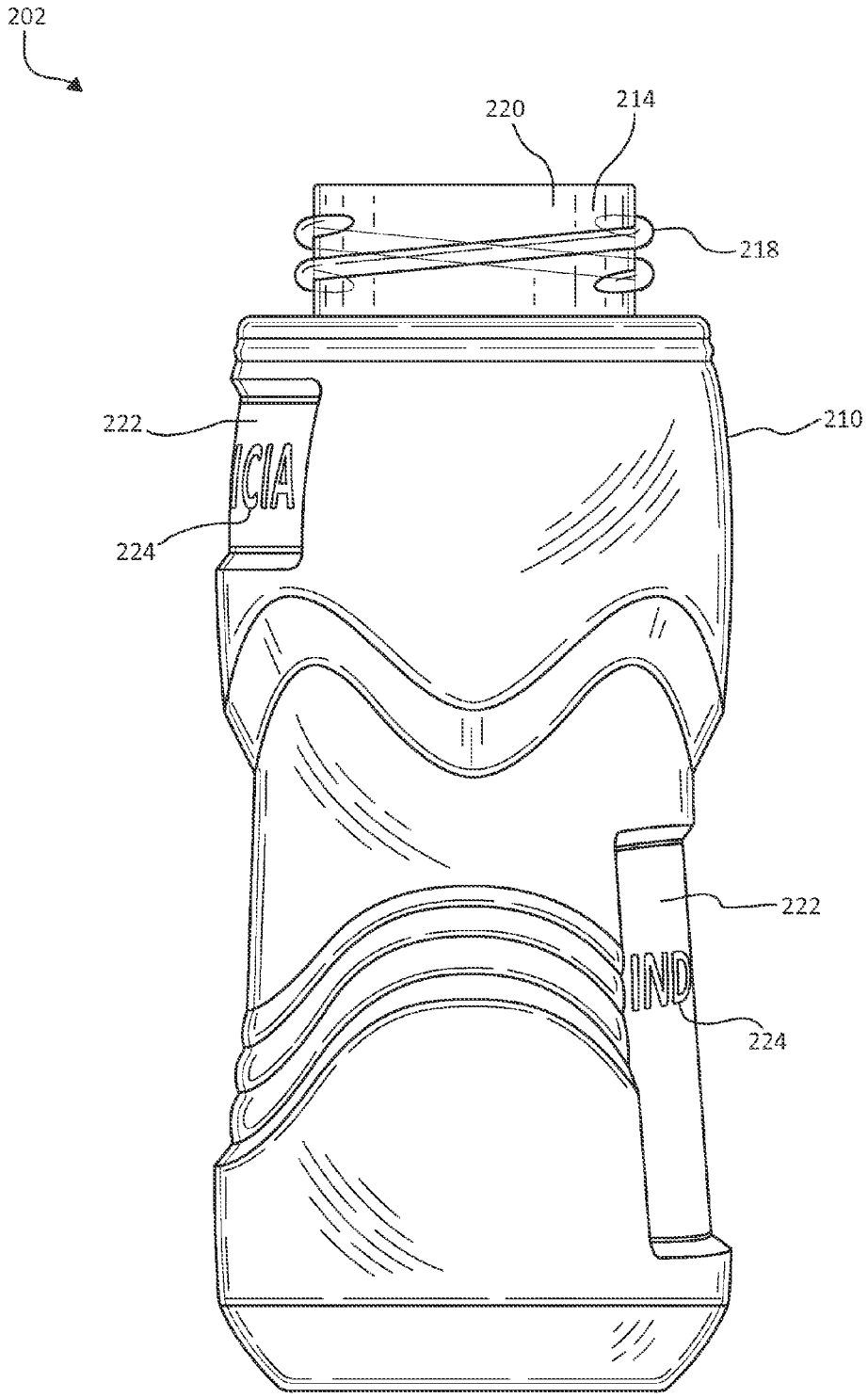
FIG. 13 is a right side view illustration of the bottle of FIG. 10 with the left side view being a mirror image of the right side view, according to one embodiment of the present invention.

Referring to FIG. 9, in one example, bubble wand 10 is provided as part of a bubble product assembly 206, which also includes a bottle 202 containing or for containing bubble solution 200 and a cover 204 for bottle 202. Bottle 202 may be of any variety of shapes and sizes large enough to selectively receive and/or hold bubble wand 10 substantially entirely therein. For example, as illustrated in FIGS. 10-13, bottle 202 includes sidewall(s) 210 defining an internal cavity 212. Bottle 202 further includes a neck 214 and an opening 216 therethrough providing access to internal cavity 212. In one embodiment, threads 218 circumferentially extend around an outer surface 220 of neck 214. In one example, bottle 202 additionally includes one or more labels 222 with indicia 224 thereon identifying product details, providing branding of bottle product assembly 206, providing aesthetic appeal to bottle product assembly 206, marketing bottle product assembly 206, etc.

Figure 14:
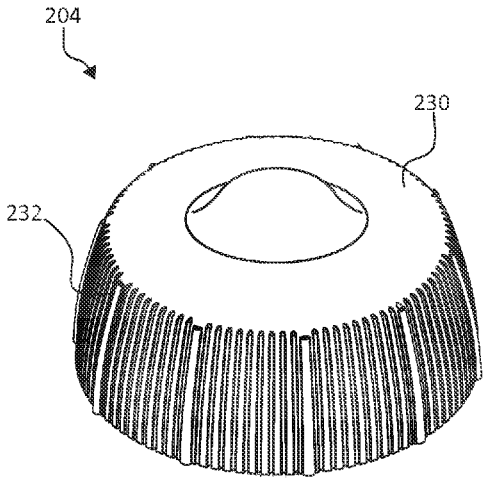
FIG. 14 is a front perspective view illustration of a bottle cover of the bubble product assembly of FIG. 9, according to one embodiment of the present invention.

In one example, cover 204 is configured to threadably couple with neck 214 of bottle 202 to close bottle 202 in a liquid tight manner. As illustrated in FIGS. 14, 15, and 17, in one embodiment, cover 204 includes top cover panel 230 and a perimeter skirt 232 extending around and depending from top cover panel 230. Perimeter skirt 232 defines an internal surface 234 with threads 236 configured to rotatably correspond with threads 218 on bottle 202 to selectively secure cover 204 to bottle 202. In one embodiment, cover panel 230 defines a reception cavity 240 extending upwardly, for example, into a central raised portion 242 of cover 204. Reception cavity 240 is sized and shaped to selectively couple with coupling feature 54 of bubble wand 10, e.g., via a snappable or other friction fit. In one example, cavity 240 includes an annular rib 244 that interact with bulbous free end 60 of bubble wand 10, more specifically, fits within annular indentation 64 of bubble wand 10 via friction, to maintain bubble wand 10 in reception cavity 240, thereby, coupling bubble wand 10 to cover 204. In this manner, a user is able to manipulate bubble wand 20 by interacting with and holding cover 204 instead of holding bubble wand 20 directly. User interaction with bubble wand 20 via cover 204, rather than directly with bubble wand 20, generally allows a user to keep his/her hands free of bubble solution 200 when care is taken in interacting with bubble solution 200 in cavity 212 of bottle 202.

Figure 16:
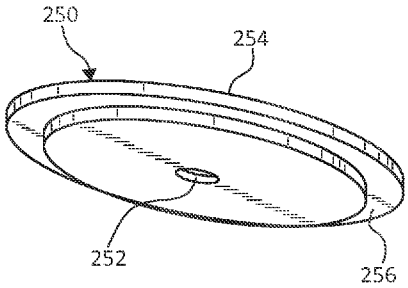
FIG. 16 is a bottom perspective view illustration of a gasket, according to one embodiment of the present invention.

In one example, a circular foam gasket 250 is sized to fit adjacent top cover panel 230 and includes an aperture 252 to align with reception cavity 240 as illustrated in FIG. 16. Gasket 250 defines a cover mating surface 254 and an opposite bottle mating surface 256. More particularly, referring to the cross-sectional view illustration of FIG. 17, gasket 250 is placed in cover 204 such that cover mating surface 254 faces top cover panel 230 of cover 204 and bottle mating surface 256 faces neck 214 of bottle 202. When cover 204 is secured around neck 214 of bottle 202, gasket 250 is tightly interposed therebetween in a compressed manner to make the seal between cover 204 and bottle 202 more nearly liquid tight. In one example, gasket 250 is placed adjacent cover panel 230 before cover 204 is coupled with bubble wand 10. In such an example, free end 60 of bubble wand 10 is moved through aperture 252 and into reception cavity 240 of cover 204 to couple bubble wand 10 to gasket 250 and cover 204 during assembly to collectively form a dipping assembly 260 as illustrated in FIG. 17-20, for example.

Figure 22:
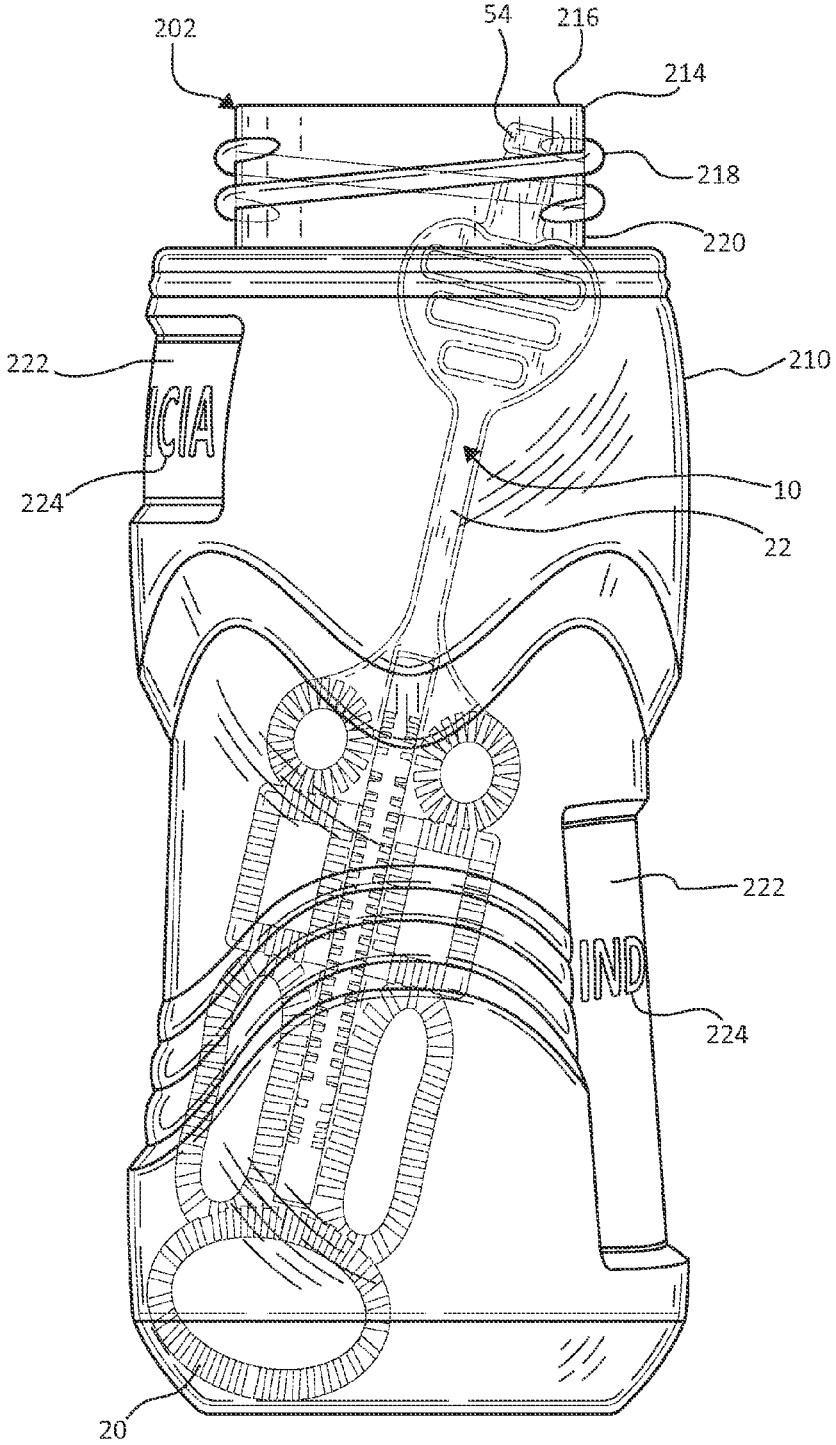
FIG. 22 is a right side view illustration of the bottle of FIG. 10 and the bubble wand of FIG. 1, according to one embodiment of the present invention.

Dipping assembly 260 is manipulated during use by being placed into cavity 212 to interact with and receive bubble solution 200 and being pulled out of cavity 212 and waved or blown at to create bubbles using bubble solution 200 suspended across bubble-forming rings 26. In one example, following use, cover 204 can be re-secured to bottle 202 while still coupled with bubble wand 10 for storage as illustrated, for example, in FIGS. 9 and 21. While bubble wand 10 may be secured to cover 204 prior to retail sale or other distribution to users, in one instance, bubble wand 10 is initially placed in bottle 10 and leaned against an interior surface of sidewall 210 without coupling bubble wand 10 to cover 204 as shown in FIG. 22. When a user first opens bottle 202, bubble wand 10 is pulled from cavity 212 and coupled with cover 204 via central cavity 240 of cover 204 by the end user. In one embodiment, bubble wand 10 is coupled with cover 204 before initial sale or offering as illustrated in FIG. 9. In one example, during use, a user can manipulate bubble wand 10 by holding cover 204. This allows a user to keep his/her hands out of bubble solution 200 contained within bottle 202 even while dipping bubble wand 10 in bubble solution 200. In one example, cover 204 is configured to be inverted and placed on a support surface (not shown) such that bubble wand 10 extends upwardly from cover 204, which generally maintains bubble wand 10 in an inverted, upright position above a support surface.

Bubble wands according to the present invention, for example, per the embodiments shown and described herein, provide a dual planar surface for forming bubbles in a readily easily assembled manner (e.g., a manner assembled generally without the use of tools) and in a substantially inexpensive manner. The resultant bubble wand generally provides improved functionality and ease of use as compared to the relatively simple wands generally provided with and inside a bottle of bubble solution. In examples, the dual planar surfaces each including bubble-forming rings allows more bubble solution to be drawn each time the bubble wand is dipped in the bubble solution resulting in more bubbles being formed per dip, which, in turn, generally results in more fun, less frustration, and less mess during use. Results are dependent, in part, on the particular bubble solution being used. In addition, by having bubble-forming rings on dual planes, in one example, a user initially blows or otherwise create bubbles through the bubble-forming rings of one plane and subsequently blows or otherwise creates bubbles through the bubble-forming rings of the different plane, thereby, generally increasing the overall enjoyment time with each dip of the bubble wand. In another example, a user rotates the bubble wand and blows at the bubble wand substantially along a line that is angled, and not parallel, with either of the dual planes such that bubbles are formed through the bubble-forming rings of both planes substantially simultaneously, thereby, generally creating more bubbles per blow or other introduction of air movement through the bubble-forming rings.

Although the invention has been described with respect to particular embodiments, such embodiments are meant for illustrative purposes only and should not be considered to limit the invention. Various alternatives and changes will be apparent to those of ordinary skill in the art upon reading this application. Other modifications within the scope of the invention and its various embodiments will be apparent to those of ordinary skill.

What is claimed is:

1. A bubble wand comprising:

a primary member substantially entirely formed in a first, single plane and defining an elongated slot and a first plurality of bubble-forming rings, wherein the first plurality of bubble-forming rings includes a different bubble-forming ring positioned on each of at least two opposing sides of the elongated slot, and each of the first plurality of bubble-forming rings defines an opening therethrough, and the primary member includes:

a bubble-forming body, which defines the first plurality of bubble-forming rings and the elongated slot, the elongated slot being interposed between at least two of the first plurality bubble-forming rings, and an elongated handle extending away from the bubble-forming body; and an auxiliary member substantially entirely formed in a second, single plane and coupled to the primary member such that the auxiliary member extends through the elongated slot of the primary member such that a first side portion of the auxiliary member is maintained on a first side of the primary member and a second side portion of the auxiliary member is maintained on a second side of the primary member, wherein the auxiliary member defines at least one additional bubble-forming ring in each of the first side portion and the second side portion of the auxiliary member.

2. The bubble wand of claim 1, wherein the elongated slot has a width substantially equal to a thickness of the auxiliary member.

3. The bubble wand of claim 1, wherein the primary member and the auxiliary member extend substantially perpendicularly relative to one another.

4. The bubble wand of claim 1, wherein an axial centerline of the primary member and an axial centerline of the auxiliary member are substantially collinear.

5. The bubble wand of claim 4, wherein the first, single plane is offset at least about 45 degrees relative to the second, single plane about the axial centerlines of the primary member and the auxiliary member.

6. The bubble wand of claim 4, wherein the elongated slot is defined along the axial centerline of the primary member.

7. The bubble wand of claim 4, wherein the elongated handle extends away from the bubble-forming body along a portion of the axial centerline of the primary member.

8. The bubble wand of claim 7, wherein the elongated handle defines a coupling feature opposite the bubble-forming body for toollessly coupling with a bottle cover.

9. The bubble wand of claim 8, in combination with a bottle and the bottle cover.

10. The combination of claim 9, further comprising bubble solution maintained within the bottle.

11. The bubble wand of claim 1, wherein:

the second side portion of the auxiliary member defines a cantilever extending over a topmost edge of the first side portion of the auxiliary member, the cantilever having a hook at a free end of the cantilever, the hook extends away from the elongated slot, the primary member defines an internal edge extending along a perimeter of the elongated slot, and a thickness of the primary member adjacent the internal edge of the primary member is secured between the hook of the cantilever and an opposing surface of the second portion of the auxiliary member to maintain the primary member coupled to the auxiliary member.

12. The bubble wand of claim 1, wherein each of the first plurality of bubble-forming rings and each of the at least one additional bubble-forming ring defines a toothed perimeter extending around a corresponding opening extending through each of the first plurality of bubble-forming rings and the at least one additional bubble-forming ring.

13. The bubble wand of claim 1, wherein each of the primary member and the auxiliary member is a single injection molded piece formed separately from the other of the primary member and the auxiliary member.

14. A bubble-forming assembly comprising:

a bubble-forming body defining a plurality of bubble-forming apertures divided from one or more others of the plurality of bubble-forming apertures by an opening extending through the bubble-forming body separate from the plurality of bubble-forming apertures, wherein the bubble-forming body is substantially two-dimensional; and a cross member defining additional bubble-forming apertures divided by a solid, elongated spine, wherein the solid, elongated spine is positioned and secured in the opening of the bubble-forming body such that the cross member bisects the bubble-forming body and positions the additional bubble-forming apertures in a plane intersecting the substantially two-dimensional bubble-forming body.

15. The bubble-forming assembly of claim 14, wherein the bubble-forming body defines an axial centerline, the cross member defines an axial centerline, and the axial centerline of the bubble-forming body and the axial centerline of the cross member are substantially collinear.

16. The bubble-forming assembly of claim 14, wherein the cross member extends substantially perpendicularly relative to the substantially two-dimensional bubble-forming body.

17. The bubble-forming assembly of claim 14, further comprising an elongated handle extending away from the bubble-forming body and formed as a single piece with the bubble-forming body.

18. The bubble-forming assembly of claim 14, wherein the cross member includes a coupling extension including a hook spaced from an opposite protrusion, and a thickness of the bubble-forming body immediately adjacent the opening is maintained between the hook and the opposite protrusion of the coupling extension.

19. A method of assembling a bubble wand assembly, the method comprising:

providing a primary member formed in a single plane and including a plurality of open, bubble-forming rings each divided from others of the plurality of open, bubble-forming rings by an elongated slot;

sliding an auxiliary member partially through the elongated slot to intersect the primary member such that a first side portion of the auxiliary member extends on one side of the primary member and a second side portion of the auxiliary member extends on an opposite side of the primary member, wherein each of the first side portion and the second side portion defines at least one additional bubble-forming ring; and after sliding the auxiliary member, toollessly securing the auxiliary member relative to the primary member.

20. The method of claim 19, further comprising toollessly securing the primary member to a cover for a bottle.

21. The method of claim 20, wherein:

sliding the auxiliary member includes deflecting a cantilevered portion of the auxiliary member to move the cantilevered portion through the opening, and toollessly securing the auxiliary member relative to the primary member includes the cantilevered portion of the auxiliary member biasing back to an original position to facilitate maintaining a thickness of the primary member between two spaced protrusions of the auxiliary member and adjacent to the cantilevered portion of the auxiliary member.

22. The method of claim 20, wherein the primary member and the auxiliary member collectively define a bubble wand, and the method further comprises:

placing the bubble wand through an opening of the bottle and into a cavity of a bottle, substantially filling the cavity with bubble solution, and securing the cover over the opening to maintain the bubble wand and the bubble solution in the cavity.

23. The method of claim 19, wherein the primary member includes:

a bubble-forming body, which independently defines the elongated slot and the plurality of open, bubble-forming rings, an elongated handle extending away from the bubble-forming body, and the auxiliary member fills the elongated slot such that the elongated slot cannot be used for forming bubbles with bubble solution.

* * * * *